US007346514B2

(12) United States Patent
Herre et al.

(10) Patent No.: US 7,346,514 B2
(45) Date of Patent: Mar. 18, 2008

(54) DEVICE AND METHOD FOR EMBEDDING A WATERMARK IN AN AUDIO SIGNAL

(75) Inventors: Jürgen Herre, Buckenhof (DE); Ralph Kulessa, Feucht (DE); Christian Neubauer, Nürnberg (DE); Frank Siebenhaar, Nürnberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 749 days.

(21) Appl. No.: 10/481,860

(22) PCT Filed: May 10, 2002

(86) PCT No.: PCT/EP02/05173

§ 371 (c)(1),
(2), (4) Date: Dec. 18, 2003

(87) PCT Pub. No.: WO02/103695

PCT Pub. Date: Dec. 27, 2002

(65) Prior Publication Data

US 2004/0184369 A1 Sep. 23, 2004

(30) Foreign Application Priority Data

Jun. 18, 2001 (DE) ..... 101 29 239

(51) Int. Cl.
*G10L 11/00* (2006.01)
*G04L 9/00* (2006.01)

(52) U.S. Cl. ..... 704/273; 704/200.1; 713/176

(58) Field of Classification Search ..... None
See application file for complete search history.

(56) References Cited

U.S. PATENT DOCUMENTS 5,319,735 A 6/1994 Preuss et al. ..... 395/2.14

(Continued)

FOREIGN PATENT DOCUMENTS

DE 195 81 594 3/1995

(Continued)

OTHER PUBLICATIONS

J. Lacy et al. "On combining watermarking with perceptual coding," Int. Conf. Acoustics, Speech, and Sig. Proc., May 1998. □□.*

(Continued)

*Primary Examiner*—V. Paul Harper
(74) *Attorney, Agent, or Firm*—Michael A. Glenn; Glenn Patent Group

(57) ABSTRACT

Prior to embedding a watermark in an audio signal, a spectral representation of the audio signal and a spectral representation of the watermark signal are determined. The spectral representation of the watermark signal is then processed on the basis of a psychoacoustic masking threshold of the audio signal. The processed watermark signal is combined with the audio signal to obtain an audio signal bearing a watermark. The spectral representation of the watermark signal is processed iteratively as follows: first a predetermined watermark initial value is selected, then the interference introduced into the spectral representation of the audio signal after a quantization of the spectral representation of the audio signal is determined and then, if the interference introduced by the watermark initial value exceeds the predetermined interference threshold, the watermark initial value is modified progressively until the resulting interference introduced into the spectral representation of the audio signal after quantization is less than or equal to the predetermined interference threshold. The modified watermark initial value at the end of the iteration is used as the processed watermark signal to be combined with the audio signal. As a result it is no longer possible for a watermark to be quantized out. Instead, full control over the energy of the watermark is achieved. A watermark can therefore be embedded in an audio signal to provide either the best possible degree of watermark detectability or the best possible audio quality.

16 Claims, 4 Drawing Sheets

U.S. PATENT DOCUMENTS

| | | | | |
|---|---|---|---|---|
| 6,061,793 | A * | 5/2000 | Tewfik et al. | 713/176 |
| 2004/0024588 | A1* | 2/2004 | Watson et al. | 704/200.1 |

FOREIGN PATENT DOCUMENTS

| | | |
|---|---|---|
| DE | 199 06 512 | 2/1999 |
| DE | 199 38 095 | 8/1999 |
| DE | 199 47 877 | 10/1999 |
| JP | 11316599 | 11/1999 |
| JP | 2000209097 | 7/2000 |
| WO | WO 97/09797 | 3/1997 |
| WO | WO 97/33391 | 9/1997 |
| WO | WO 01/99109 | 12/2001 |

OTHER PUBLICATIONS

Neubauer "Advanced Watermarking and its Applications" AES Sep. 2000.*

Boney, L. et al.; Digital Watermarks for Audio Signals; 1996; IEEE.

Eklund, Roberta; Audio Watermarking Techniques; 2002.

Garcia, Rocardo; Digital Watermarking of Audio Signals Using a Psychoacoustic Auditory Model and Spread Spectrum Theory; 2002.

Neubauer, C. et al.; Audio Watermarking of MPEG-2 ASC Bit Streams.

Neubauer, C., et al.; Continuous Steganographic Data Transmission Using Uncompressed Audio; 1996.

Siebenhaar, F., et al.; Combined Compression/Watermarking for Audio Signals; 2001.

Seok, J., et al.; A Novel Audio Watermarking Algorithm for Copyright Protection of Digital Audio; 2002.

* cited by examiner

DEVICE AND METHOD FOR EMBEDDING A WATERMARK IN AN AUDIO SIGNAL

FIELD OF THE INVENTION

The present invention relates to the field of audiocoding and in particular to methods and devices for embedding a watermark in an audio signal.

BACKGROUND OF THE INVENTION AND PRIOR ART

Modern audiocoding methods process time-discrete audio sampled values to generate a bit stream which is compressed in relation to the original audio signal. The stream of time-discrete audio sampled values is first windowed so as to generate successive blocks of windowed audio sampled values from the stream of audio sampled values. The additional processing takes place blockwise. A block of audio sampled values generated by windowing is typically converted into a spectral representation by means of an analysis filter bank. The spectral representation comprises neighbouring frequency spectral values from the frequency 0 to the maximum audio frequency, which may e.g. be 16 kHz. The audio spectral values are grouped into scale factor bands and quantized. The quantization is so achieved that the quantization noise introduced by quantization is so dimensioned that it is masked by the audio signal. To this end a psychoacoustic model is used which, on the basis of the audio signal, supplies for each scale factor band an energy value which indicates the energy level up to which the quantization noise is masked, i.e. will not be audible in the decoded audio signal. If the quantization noise introduced by the quantizer should exceed the psychoacoustic masking threshold, the decoded audio signal will contain audible interference. The quantization stages of the quantizer are calculated in accordance with the masking threshold. When the quantization stages have been calculated, the audio spectral values are quantized in the light of these quantization stages to obtain quantized audio spectral values. For reasons of data efficiency the quantized audio spectral values are subjected to an entropy coding, e.g. a Huffman coding, to generate a bit stream with code words representing the audio spectral values. Side information is added to the stream of code words using a bit stream multiplexer. This side information contains, inter alia, the scale factors on the basis of which an audio decoder can ascertain the quantization stages which have been used in the encoder.

The audio decoding entails splitting the bit stream together with the side information into code words on the one hand and side information on the other using a bit stream demultiplexer. First, the entropy coding is revoked. The entropydecoded values, i.e. the quantized audio spectral values, are then subjected to an inverse quantization so as to obtain inverse quantized spectral values. These are then converted from the frequency domain to the time domain using a synthesis filter bank. The decoded audio signal is then present at the output of the synthesis filter bank.

It should be noted that the coding method used here entails loss since quantization has been performed in the encoder. The decoded audio signal does not correspond exactly to the original audio signal. If encoding and decoding were successful, the subjective impression made on the hearing by the decoded audio signal will, however, correspond to that made by the original audio signal since the quantization noise introduced in the encoder by the quantizer is masked out, i.e. it is "hidden" below the psychoacoustic masking threshold.

For reasons of data efficiency the quantization steps should preferably be as big as possible. On the other hand, if the quantization steps are too big, so too will be the quantization noise, which can manifest itself as audible interference in the decoded signal. Modern audiocoding methods strive for an optimal compromise between these two requirements.

The psychoacoustic masking threshold of an audio signal section depends on the actual input audio signal. If the audio signal changes with time, so too do the masking properties. For reasons of data efficiency it is preferable that as much quantization noise as possible should be introduced into the audio signal, i.e. the quantization noise should correspond as closely as possible to the psychoacoustic masking threshold. Audio signal sections with good masking properties can then be encoded with a relatively small bit outlay, whereas audio signal sections with relatively poor masking properties, such as e.g. tonal audio signal sections, must be quantized very finely, which means that a large number of bits must be expended in order to encode these audio signal sections. An encoder which tries to introduce just that amount of interference which is dictated by the masking threshold will therefore generate an audio signal of constant quality. Due to the time variant nature of the input signal this leads, however, to a variable bit rate at the output of the encoder. Although encoding with constant quality—and thus with a variable bit rate—is attractive as regards data efficiency on the one hand and audio quality on the other, this concept is disadvantageous in that it is only suitable for applications which support a variable transmission rate, such as e.g. the storage of compressed audio signals or the transmission of compressed audio signals over packet-based networks, e.g. the internet.

However, many applications require an audio encoder with a constant transmission rate. Due to the time variant nature of the spectral and temporal properties of an audio signal, this of necessity entails a variable quality. In particular, depending on the bit rate, it may happen that sections of the audio signal which have relatively poor masking properties cannot be quantized finely enough, i.e. are under-encoded, and may contain audible interference in the decoded signal, while easily encodable segments, i.e. audio signal sections with good masking properties, have to be encoded more precisely than necessary, i.e. are over-encoded.

To avoid the disadvantages of over-encoding and under-encoding a bit banking function is normally employed. The bit bank (Bitsparkasse) is filled when easily encodable audio sections are encoded. The bits which are not required to encode these easily encodable sections are not simply "wasted" through an unnecessarily fine quantization but instead a coarser quantization is used and the superfluous bits are "parked" in the bit bank.

If, on the other hand, it is a question of audio sections which are difficult to encode, i.e. for which a smaller quantization step width than is possible because of the required constant average data rate must be employed, the bit bank is "emptied" for this purpose so as to achieve a finer quantization than would otherwise be possible taking account of the required data rate, thus ensuring that there is no audible interference in these sections either in the decoded audio signal. The bit banking function thus serves as a buffer to transform an "inner" audio encoder with a variable bit rate into an "outer" audio encoder with a constant bit rate.

The distribution of music e.g. over the internet is now developing into an increasingly important technology. Most of the music content is compressed to save storage space and to speed up the transmission over transmission channels with limited bandwidth. Supervision of the use of the musical items distributed in transmission networks or tracing illegal copies of the same is, however, an ever increasing problem. While, on the one hand, wide distribution of audio items is desirable, copyrights must nevertheless be respected. In this context watermarking constitutes a useful mechanism for tracing illegal copies or for incorporating copyright information or quite generally the intellectual property into the items in the audio signal.

Incorporating watermarks into uncompressed multimedia data such as pictures, video, audio etc. is known. Incorporating watermarks into compressed material, however, requires a fast, quality-preserving watermarking method.

The technical publication "Audio Watermarking of MPEG-2-AAC Bit Streams", Christian Neubauer, Jürgen Herre, 108th AES Convention, Paris 2000, Preprint 5101 first teaches that a spectral representation of an audio signal be generated. A spread and spectrally transformed watermark signal is then added to this. A new bit stream is generated from the sum signal through quantization and Huffman coding. This so-called bit stream watermarking method is characterized by a low degree of computational complexity since it is not necessary to fully decode the bit stream which is to be provided with a watermark. This method is also advantageous in that it provides high audio quality since the quantization noise and the watermark noise can be coordinated with each other if the energy introduced into the audio signal by the watermark lies below the psychoacoustic masking threshold. The method is also characterized by a high degree of robustness, since the watermark cannot be extracted from the decoded audio signal by an illegal distributor of the audio signal without detracting from the audio quality.

A disadvantage of the cited method is, however, that the quantization of the watermark-bearing signal may result in the watermark being quantized out or weakened. This is due to the fact that the energy of the watermark signal sometimes lies in the range of the quantization interval. Furthermore, it provides only limited control over the interference introduced by the watermark, which may result in a loss of audio quality.

A further watermarking method is the embedding of the watermark during the compression of the audio signal. This concept is described in the technical publication "Combined Compression/Watermarking for Audio Signals", Frank Siebenhaar, Christian Neubauer and Jürgen Herre, 110th AES Convention, 12th to 15th May 2001, Amsterdam, Preprint 5344. An uncompressed audio signal is first presented to a psychoacoustic model to determine the masking threshold. The audio signal is then transformed into the frequency domain. The spread spectrally represented watermark signal is weighted in the light of the masking threshold in the frequency domain and added to the spectrum of the input audio signal. The parameters for the quantization are determined in the light of the masking threshold, whereupon the watermark-bearing signal is quantized and encoded. This method too is characterized by a low degree of computational complexity since combining the embedding of the watermark and the encoding means that certain operations, such as e.g. the calculation of the masking model and the transposing of the audio signal to a spectral representation only have to be performed once. The method also normally provides a good audio quality since quantization noise and watermark noise can be matched to each other.

A disadvantage of this method is, as above, that the quantization of the watermark-bearing signal may result in the watermark being quantized out or weakened. This is again due to the fact that the energy of the watermark signal sometimes lies in the range of the quantization interval. Furthermore, it provides only limited control over the interference introduced by the watermark, which may result in a loss of audio quality.

If the spectral representation of the audio signal is examined a plurality of audio spectral values can be seen. The spread watermark signal is also characterized by a plurality of spectral lines. To prevent the watermark from producing audible interference in the decoded audio signal, the height of the watermark spectral lines is, however, considerably less than the height of the audio signal spectral lines. After adding the watermark spectrum to the audio spectrum the combined spectrum is only a slight modification of the original spectrum. The quantization of the combined spectrum which follows will then remove the watermark without replacement if the quantization step width is greater than the height of the watermark spectral lines which are quantized with this quantization step width. If too many watermark spectral lines are "quantized out" by the subsequent quantization, the watermark detector can no longer extract an unambiguous watermark.

SUMMARY OF THE INVENTION

It is the object of the present invention to provide an improved concept for embedding a watermark in an audio signal which provides good audio quality on the one hand and ensures good watermark detectability on the other.

This object is achieved by a method for imbedding a watermark in an audio signal according to claim 1 or by a divice for embedding a watermark in an audio signal according to claim 16.

In accordance with a first aspect of the invention, this object is achieved by a method for embedding a watermark in an audio signal, comprising the following steps: providing a spectral representation of the audio signal, wherein the spectral representation of the audio signal has a plurality of audio spectral values; providing a spectral representation of the watermark signal, wherein the spectral representation of the watermark signal has a plurality of watermark spectral values; processing the spectral representation of the watermark signal in response to a psychoacoustic masking threshold of the audio signal to obtain a processed watermark signal such that the interference introduced into the audio signal by the processed watermark signal lies below a predetermined interference threshold which depends on the psychoacoustic masking threshold; and combining the processed watermark signal and the audio signal to obtain a watermark-bearing audio signal in which the watermark is embedded, wherein the step of processing comprises the following substeps: selecting a predetermined watermark initial value, which depends on the spectral representation of the watermark signal; determining the interference introduced into the spectral representation of the audio signal by the predetermined watermark initial value after quantization of the spectral representation of the audio signal; and if the interference introduced by the watermark spectral value exceeds the predetermined interference threshold, modifying the watermark initial value until the interference introduced into the spectral representation of the audio signal by a modified watermark initial value after quantization of the audio signal is smaller than or equal to the predetermined interference threshold, and using the modified watermark initial value as the processed watermark signal.

In accordance with a second aspect of the invention, this object is achieved by a device for embedding a watermark in an audio signal, comprising: a unit for providing a spectral representation of the audio signal, wherein the spectral representation of the audio signal has a plurality of audio spectral values; a unit for providing a spectral representation of the watermark signal, wherein the spectral representation of the watermark signal has a plurality of watermark spectral values; a unit for processing the spectral representation of the watermark signal in response to a psychoacoustic masking threshold of the audio signal to obtain a processed watermark signal such that the interference introduced into the audio signal by the processed watermark signal lies below a predetermined interference threshold which depends on the psychoacoustic masking threshold; and a unit for combining the processed watermark signal and the audio signal to obtain a watermark-bearing audio signal in which the watermark is embedded, wherein the unit for processing comprises: a unit for selecting a predetermined watermark initial value, which depends on the spectral representation of the watermark signal; a unit for determining the interference introduced into the spectral representation of the audio signal by the predetermined watermark initial value after quantization of the spectral representation of the audio signal; a unit for determining whether the interference introduced by the watermark initial value exceeds the predetermined interference threshold; and a unit for modifying the watermark spectral values until the interference introduced into the spectral representation of the audio signal by a modified watermark initial value after quantization is smaller than or equal to the predetermined interference threshold, and for using the modified watermark spectral values as the processed watermark signal.

The present invention is based on the finding that better watermark detectability can be achieved if account is taken of the fact that the audio signal together with the watermark is subjected to quantization. A watermark will only be detectable if the watermark causes a spectral line representing the watermark and the audio signal to fall within a different quantization stage than it would if no watermark were embedded.

Only in this case will a watermark detector, which receives only quantized information, be able to detect a watermark. Expressed differently this means that when a spectral line representing the watermark and the audio signal falls within the same quantization stage as the corresponding spectral line representing the audio signal alone, the embedding of the watermark was in vain since no energy component which arises from the watermark will be seen in the quantized signal. The watermark has been quantized out.

In accordance with the present invention the spectral representation of the watermark signal is therefore processed in such a way that it is ensured that the watermark signal processed in the processing step is still present after quantization. To ensure this, a predetermined watermark initial value is chosen which depends on the spectral representation of the watermark signal. Naturally the interference in the audio signal due to the watermark must be either zero or of very small magnitude. For this reason the interference introduced into the audio signal by the predetermined watermark initial value is determined, the criterion being the conditions after quantization of the spectral representation of the audio signal. In this way it is possible, on the one hand, to see whether something of the watermark remains after quantization and, on the other hand, to ensure that the interference due to the watermark after quantization is as it should be. If the interference introduced by the watermark initial value exceeds a predetermined interference threshold, the watermark initial value is changed progressively until the interference introduced into the spectral representation after quantization by a modified watermark initial value is smaller than or equal to the predetermined interference threshold. The modified watermark initial value obtained in this way is then combined with the audio signal to obtain the watermark-bearing audio signal in which the watermark is embedded.

An advantage of the present invention is that conditions which in the final analysis do not correspond to the output conditions, namely the audio signal/watermark conditions prior to quantization, are no longer considered. Instead, the watermark is modified progressively, e.g. by iteration, until a desired watermark "interference energy" is found. In accordance with the present invention the conditions which pertain after the quantizer, i.e. the conditions which are most important for the audio signal decoder and for the watermark extractor, are now taken into account.

Although in the prior art the watermark energy was normally set to a value which is smaller than or equal to the psychoacoustic masking threshold, the problem remained as to what happens to the watermark signal during quantization. As has been explained, it might be that the watermark signal is quantized out, with the result that either no watermark or only a very weak watermark could be extracted from the decoded signal. What might also happen is that the interference which is introduced by the watermark was audible in the decoded signal despite the watermark having been so weighted that it falls below the masking threshold.

In accordance with the present invention precise control is now achieved as a result of the processing of the watermark on the basis of the conditions pertaining after quantization. This control has the advantage that not only can it be ensured on the one hand that the watermark causes either no or only minimally audible interference, but also that adequate watermark detectability can be guaranteed at the same time. Furthermore, the method according to the present invention also provides the advantage that, in cases where good detectability is particularly important, a certain degree of—tolerable—interference can be deliberately introduced into the audio signal in the interests of a higher watermark detectability, whereas in other cases where the watermark detectability does not have to be guaranteed in all circumstances and at all times, it is possible to make concessions as regards watermark detectability in order to fulfil the highest audio quality requirements.

In the preferred embodiment of the present invention the watermark signal is added to the audio signal prior to quantization to provide a combined signal. The combined signal is then quantized and inversely quantized and is then compared with the original audio signal. From the comparison it is determined whether the interference introduced by the watermark is tolerable. If it is established that the interference is not tolerable, the spectrum of the watermark signal is weighted iteratively using particular strategies and a quantization and inverse quantization are then performed again until it is established that the interference is now tolerable. The watermark spectrum obtained by this process is then added to the original audio spectrum. The summed or combined signal is then quantized, entropy coded and provided with side information to obtain an audio bit stream containing the watermark.

In another embodiment of the present invention the original audio signal is quantized. A quantized watermark is added to the audio signal to produce the combined signal. The combined signal is then no longer quantized again, as in the first embodiment, but is entropy coded directly. The "quantized" watermark signal introduced into the quantized audio signal is here so adjusted that, on the one hand, the requirement that the interference should be tolerable is fulfilled, and on the other that a desired watermark detectability is achieved.

Irrespective of whether the combined signal is still to be quantized or the combined signal is already available in quantized form, precise control of the interference introduced into the signal by the watermark is achieved.

BRIEF DESCRIPTION OF THE DRAWINGS

Preferred embodiments of the present invention are explained in detail below making reference to the enclosed drawings, in which.

DETAILED DESCRIPTION OF PREFERRED EMBODIMENTS

Figure 1:
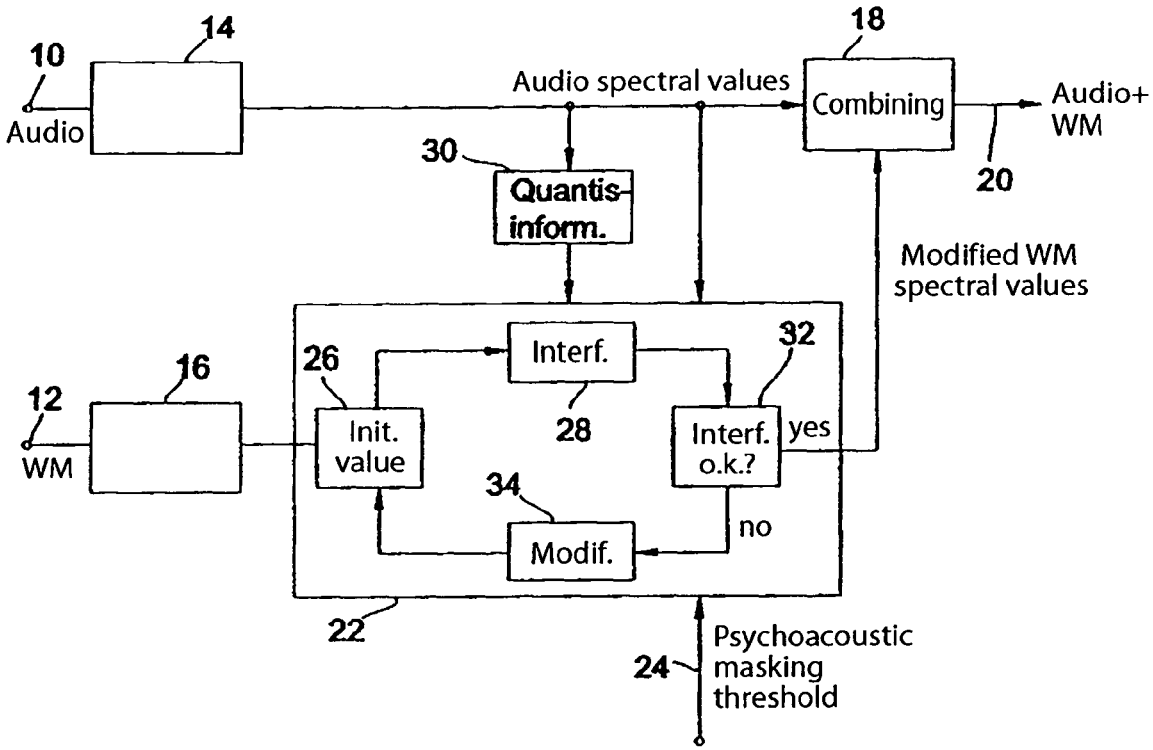
FIG. 1 shows a block diagram of a device according to the present invention for embedding a watermark in an audio signal.

The device according to the present invention shown in FIG. 1 has an audio input 10 and a watermark input 12. Both the audio signal at the audio input 10 and the watermark signal at the watermark input 12 are transformed into a spectral representation by units 14 and 16 respectively. The spectral representation of the audio signal comprises audio spectral values, whereas the spectral representation of the watermark signal comprises watermark spectral values. The audio spectral values are combined with modified watermark spectral values in a unit 18 for combining to provide the combined audio signal with embedded watermark at an output 20. According to the present invention a unit 22 for processing the spectral representation of the watermark signal in accordance with a psychoacoustic masking threshold supplied via an input 24 is provided for this purpose. The spectral representation of the watermark signal is processed according to the psychoacoustic masking threshold received via the input 24 to produce a processed watermark signal such that the interference introduced into the audio signal by the processed watermark signal lies below a predetermined interference threshold which depends on the psychoacoustic masking threshold.

To this end the unit 22 for processing the spectral representation of the watermark signal includes a unit 26 for selecting a predetermined watermark initial value which depends on the spectral representation of the watermark signal. The interference introduced into the spectral representation of the audio signal by the predetermined watermark initial value after quantization of the spectral representation of the audio signal is determined in a unit 28. A unit 30 for supplying quantization information provides quantization information for this purpose. The unit 30 supplies quantization information which depends on the original audio signal, i.e. the audio signal without a watermark.

Whether the interference so determined is greater than the predetermined interference threshold is investigated in a unit 32. If this is not the case, i.e. if the interference is acceptable, the watermark initial value is fed directly to the unit 18 for combining. On the other hand if this is the case, i.e. the interference introduced is too great or other than desired, a unit 34 for modifying the watermark initial value is activated until the interference introduced into the spectral representation of the audio signal after quantization by a modified watermark initial value is less than or equal to the predetermined interference threshold. This may entail the loop shown in the unit 22 for processing being traversed iteratively several times until eventually a modified watermark initial value is obtained at the output of the unit 32 which is used as the processed watermark signal and is fed to the unit 18 for combining to produce at the output 20 the audio signal in which the watermark is embedded.

Figure 2:
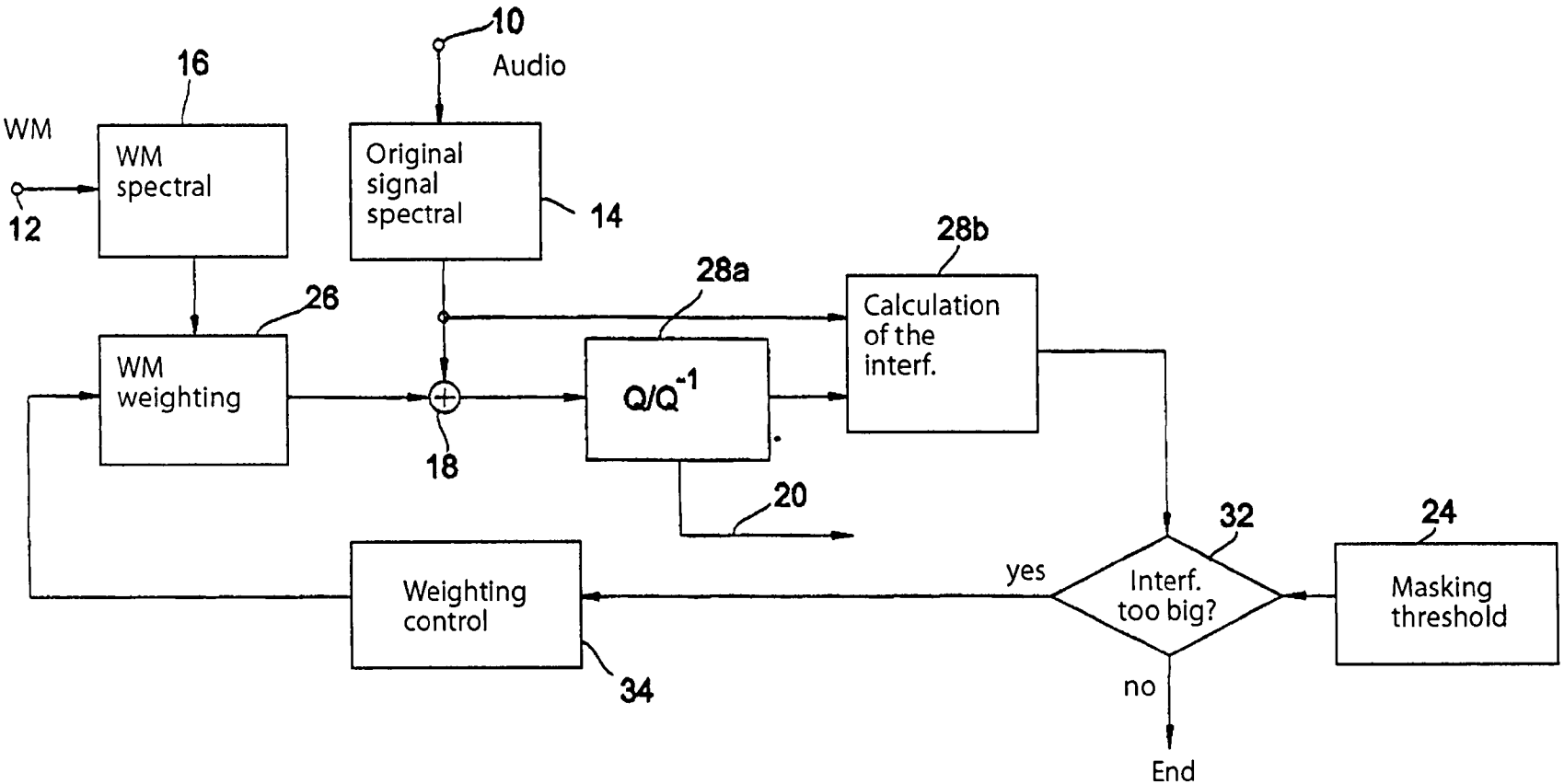
FIG. 2 shows a block diagram of a device according to the present invention for embedding a watermark in an audio signal according to a first embodiment.

In a preferred embodiment of the present invention, shown in FIG. 2, combination is achieved by an addition 18 prior to quantization. The interference introduced into the audio signal by the initial value specified by the block watermark weighting 26 is determined in the unit 28. To this end the combined signal is first quantized and inversely quantized in a quantizer/inverse quantizer unit 28*a*. The interference introduced by the watermark is then calculated, e.g. by forming the differences and squaring the difference values, in a unit 28*b* and is then compared with the psychoacoustic masking threshold 24 in the unit 32. If the interference is too great, the unit 34, labelled "weighting control" in FIG. 2, is activated to supply modified weighting factors to the block 26, after which the newly weighted watermark spectrum is combined with the original audio signal in spectral representation in the unit 18 and the iteration loop is traversed anew.

In the embodiment shown in FIG. 2 it is preferable to take as the watermark initial value the watermark spectrum which is equally weighted for all the spectral lines. The weighting factor for each spectral line is therefore for all the spectral lines equal to a constant, which is so chosen that the watermark energy exceeds the masking threshold. The watermark energy is then reduced step by step so as to "iterate" the watermark below the masking threshold.

If the unit 32 at first establishes that the interference is too large, therefore, the unit 34 for controlling the weighting factors is designed to reduce all the weighting factors, e.g. to halve them. If the interference is then still too great, all the current weighting factors could then be halved again in the next iteration step, and so on. This can be continued until the unit 32 establishes that the interference is acceptable.

Since the combination of audio signal and processed watermark signal takes place in the spectral region, i.e. not in the quantization region but prior to quantization, a quantization must still be undertaken. This can be accomplished using the quantizer section of unit 28*a*, which then delivers the output values of the quantizer section as the audio signal plus embedded watermark.

By means of an analysis-synthesis iteration as shown in FIG. 2, the interference due to the watermark after quantization is thus determined. On the one hand it can therefore be ensured that watermark energy remains in the signal even after quantization. On the other, the interference which is actually introduced can be determined, which favours the achievement of high audio quality. As shown in FIG. 2, the spectrally represented watermark signal is spectrally weighted with the current weighting factors, supplied by the block 34, using a weighting filter bank, which may be contained in the block 26. The resulting signal is added to the original audio signal. As is shown, the combined signal at the output of the unit 18 is quantized and inversely quantized and produces the signal present at the output of the unit 28*a*, which is fed into the unit 28*b* together with the original audio signal. The unit 28*b* then compares the original signal with the quantized and inversely quantized signal and determines therefrom the quantization error signal, which is fed into the unit 32. If necessary, unit 32 activates the weighting control in block 34 to determine new improved weighting factors. The masking threshold determined by the masking model and which specifies how much interference in the signal is "allowed" at a particular place in the signal spectrum, is available for this. When the block weighting control 34 has determined optimal weighting factors as regards the desired audio signal interference and the desired watermark detectability, i.e. the watermark energy, the method terminates. The quantized spectral values of the combination signal finally determined by the block 28*a* are then forwarded to the bit stream multiplexer to be formed into an audio bit stream together with the side information.

In the following reference will be made to FIG. 3 in order to present a device for embedding a watermark in an audio signal according to a second embodiment of the present invention. In contrast to the first embodiment shown in FIG. 2, wherein an unquantized audio signal is combined with an unquantized watermark signal, this combination 18 takes place in the "quantization region" in FIG. 3, i.e. a quantized audio signal is combined with a quantized watermark. This can be achieved in two ways: the quantization stages are either calculated by a quantizer 42 by quantization of the original audio signal or they are extracted from an encoded audio signal. A unit 40*a* for calculating the quantized audio signal minus a predetermined number n of quantization stages and a unit 40*b* for calculating the quantized audio signal plus a predetermined number n of quantization stages are operated in response to the quantization stages made available by the unit 42.

Figure 3:
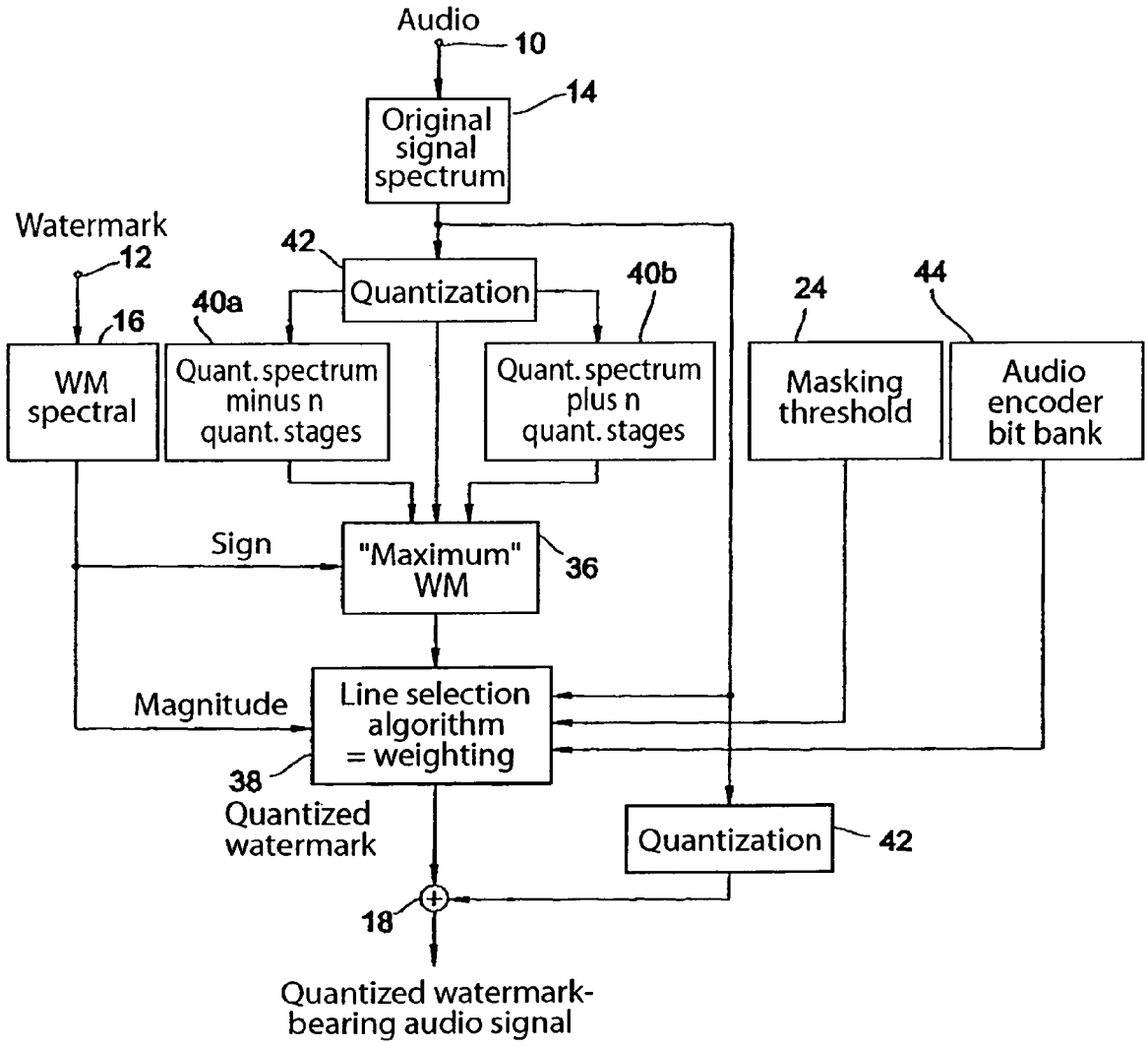
FIG. 3 shows a device according to the present invention for embedding a watermark in an audio signal according to a second embodiment.

In contrast to the embodiment shown in FIG. 2, wherein a quantization calculation and an inverse quantization calculation were performed within the iteration loop by the unit 28*a* for each combined audio signal, this occurs a priori in the second embodiment shown in FIG. 3, i.e. by means of a precalculation outside an iteration loop. To this end a so-called "maximum" watermark is first calculated as the predetermined watermark initial value by a unit 36. At first only the signs of the watermark spectrum are used to calculate the predetermined maximum watermark. If the watermark spectrum has a positive sign, the corresponding spectral value of the original quantized audio signal is increased by n quantization stages, where n is an integer greater than or equal to 1. If the sign of a watermark spectral value is negative, on the other hand, the corresponding quantized spectral value, i.e. the spectral value of the audio signal of the same frequency as the spectral value of the watermark signal whose sign is currently being considered, is decreased by n quantization stages. This results in a maximum watermark, where "maximum" is to be understood in the sense that the maximum watermark signal affects each spectral line of the original audio signal after quantization. While this case is desirable as regards a very good watermark detectability, experience has shown that it often introduces too much interference into the audio signal. To reduce the interference to a tolerable level, where a tolerable level might be the psychoacoustic masking threshold e.g., a unit 38 which implements a line selection algorithm is provided. The unit 38 determines the interference introduced into the audio signal by the maximum watermark made available by the unit 36. If the interference exceeds the predetermined interference threshold, the unit 38 progressively modifies the "maximum" watermark by selecting individual lines until the interference introduced by the watermark is less than or equal to the predetermined interference threshold. When this condition is fulfilled, the current watermark, which is already quantized, is fed into the adder 18 together with the quantized original audio signal to produce the quantized watermark-bearing audio signal at the output.

Figure 4A:
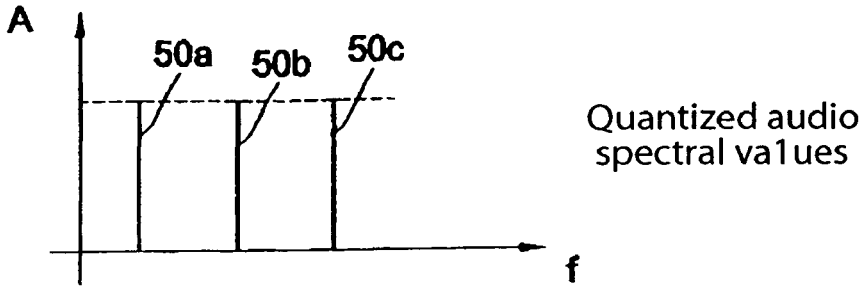
FIG. 4*a* to 4*d* shows a schematic explanation of the line selection algorithm for the second embodiment of the present invention.
Figure 4B:
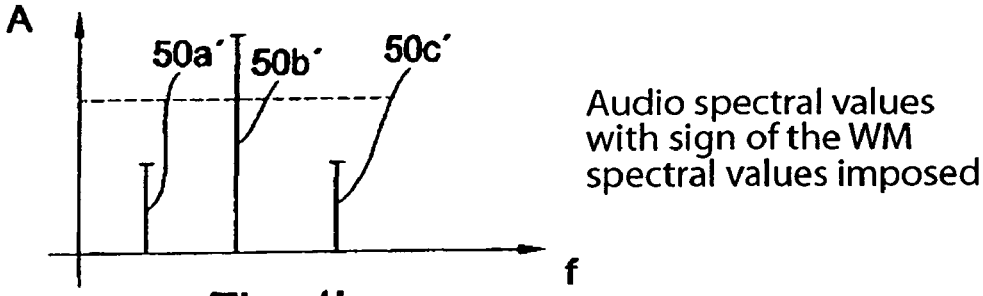
Figure 4C:
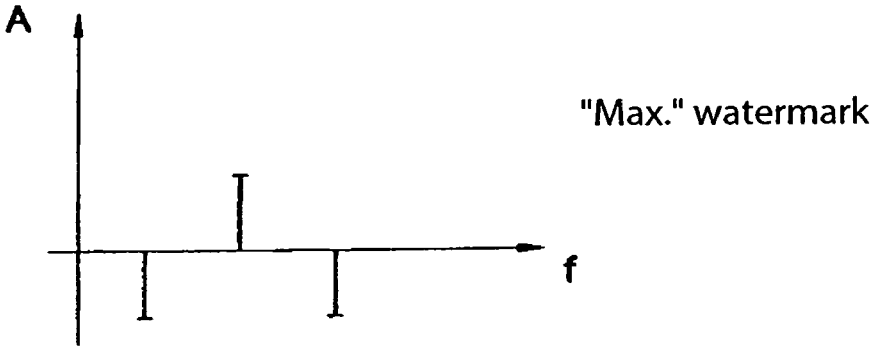

The function and mode of operation of the units 36 and 38 will now be discussed making reference to FIG. 4*a* to 4*d*. FIG. 4*a* shows an example of a quantized audio signal which, for the sake of clarity of representation, only depicts three spectral values 50*a*-50*c*. Typically, depending on the selected window length and the transform, an audio spectrum might have e.g. 1024 spectral values. The number of quantized spectral values which differ from zero depends on how many audio spectral values have been quantized to zero. In reality the quantized audio spectral values are naturally of different heights. FIG. 4*b* shows an audio spectrum with plus or minus n imposed quantization stages (depending on the sign of the watermark spectral values). The watermark spectral component corresponding to the audio spectral value 50*a* of FIG. 4*a* has a negative sign for the example shown in FIG. 4*b*. The watermark spectral component corresponding to the audio spectral value 50*b* of FIG. 4*a* has a positive sign for the example shown in FIG. 4*b*, while the third spectral component of the watermark again has a negative sign. The magnitude of the watermark spectral components at first plays no role since it is assumed that watermark detection is already possible when the quantized audio spectral values 50*a*-50*c* are altered by the watermark. The maximum watermark, which is determined by the unit 36 of FIG. 3, is shown in FIG. 4*c* for the case shown in FIG. 4*b*. It has a spectrum which is characterized by the fact that each quantized original audio spectral value is modified by one quantization stage, being either extended if the watermark has a positive sign or contracted if the watermark has a negative sign.

In the example shown in FIG. 4*b* the magnitude of a watermark spectral line could be so taken into account that incrementation or decrementation is effected not just by one but by several quantization stages if the magnitude of the watermark spectral line is large enough.

Figure 4D:
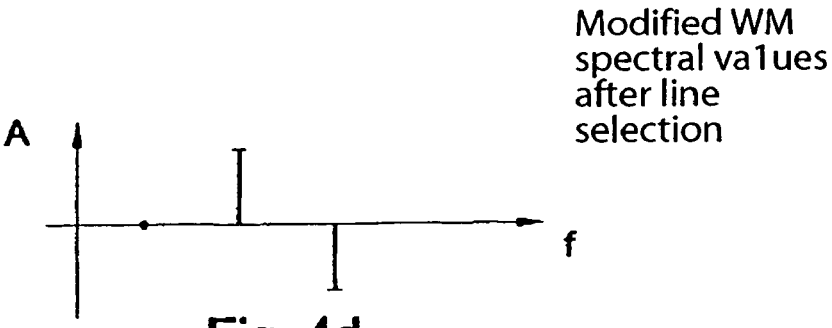

The function of the unit 38 in FIG. 3 will now be described making reference to FIG. 4*d*. If unit 38 establishes that for the left quantized audio spectral component the interference introduced by the watermark is too big when the left quantized audio spectral component 50*a* is reduced by one quantization stage, as is represented by the spectral component 50*a*', this spectral component is not selected by the unit 38, which manifests itself in the modified watermark spectral values after the line selection in that the modified watermark has a spectral line of 0 at this position. For the middle and right spectral components of the quantized audio signal, on the other hand, it was established that the interference introduced by the spectral lines 50*b*' and 50*c*' were within bounds, so that at these positions so much watermark energy can be added to the quantized audio spectral values that these can be increased by one quantization stage (50*b*') or reduced by one quantization stage (50*c*').

It is clear from the above that the precalculation of the quantization stages by the units 40*a* and 40*b* renders the step of quantization and inverse quantization, i.e. the unit 28*a* of FIG. 2, superfluous since the magnitude of the interference due to modification of the quantization index can be precalculated a priori. It can also be seen from FIG. 3 that the unit 26, i.e. the weighting of the watermark spectral lines, has also been dispensed with.

The quantized audio spectral values are now modified by e.g. plus or minus one quantization stage, depending on the watermark signal, i.e. on the sign of the watermark signal. This procedure is advantageous since it economizes on computational time since the quantization and inverse quantization (unit 28*a* of FIG. 2) and the weighting of the watermark (unit 26 of FIG. 2) can be completely dispensed with.

In the light of the precalculated audio spectrum, i.e. of the original spectrum and of the original spectrum minus n quantization stages or of the original spectrum plus n quantization stages, the maximum watermark is determined line by line (FIG. 4*c*). It will be the difference between the original spectrum (FIG. 4*a*) and the audio spectrum modified by n quantization stages (FIG. 4*b*), the difference having the same sign as the unweighted watermark.

The line selection algorithm, which is performed in unit 38, takes into account the magnitude of the unweighted watermark spectral lines, the masking threshold 24 and, perhaps, a bit banking function 44 of the audio encoder.

To ensure both good audio quality and good watermark detectability, it is preferable to select the lines of the maximum watermark in such a way that the watermark spread band signal is broadband-embedded, i.e. that as many lines as possible of the quantized audio signal are modified. Furthermore, the masking threshold or, if some other threshold than the masking threshold is used, this predetermined interference threshold, should not be breached. Finally, the structure of the watermark within a frequency band should be modified as little as possible.

All other lines of the maximum watermark are ignored. This means that, after the addition of the watermark, the quantized audio spectral values of the selected lines are modified by plus n or minus n quantization stages, while the quantized audio spectral values of the unselected watermark lines are adopted unchanged.

The quantized watermark-bearing audio signal at output 20 of the device shown in FIG. 3 must now still be entropy coded.

Depending on the audio coding method into which the concept according to the present invention is integrated, a bit banking function may be incorporated, which can make additional bits available to later signal blocks, as has been explained. The line selection strategy is preferably adapted to the filling status of the bit bank. When the bit bank is full, for example, it is then also possible to impress a watermark on quantized audio spectral values of the original audio signal having the value 0, something which would not normally be allowed on account of the bit requirement. As a result the watermark detection can be improved substantially.

In applications featuring combined embedding/encoding the original values after the transformation into the frequency domain are also available in addition to the already quantized audio spectral values. The quantization of the original audio spectral values can also be seen as a form of watermark embedding since a certain degree of audio spectrum interference results both on quantization and on the addition of a watermark signal. The interference introduced by quantization cannot be regarded as a watermark, however, on account of its random nature. When the interference introduced by quantization has the same sign as the watermark, however, the quantization noise supports the detectability of the watermark. This results in the following cases.

Through the quantization of an audio spectral line the watermark is introduced with the correct sign. The unit 38 of FIG. 3 is here preferably so arranged that it refrains from introducing further watermark interference in view of the fact that for a certain frequency interference has already been introduced with the appropriate phase in respect of the watermark spectral value. Alternatively an additional quantization stage could be included in order to improve the detectability still further.

If, on the other hand, the quantization of an audio spectral line has introduced interference with the opposite sign to that of the watermark signal, which results in the watermark being degraded to a certain extent due to the opposite quantization, it must be considered on the basis of the line selection strategies explained above whether the robustness of the watermark must be guaranteed for this line and the quantized audio spectral value needs therefore to be modified in order to "reverse" so to speak the quantization noise, or whether the embedded watermark at this position, i.e. the quantization noise at this position, should have a "false" sign with a view to providing a better audio quality.

As has already been explained, in modern coding methods the psychoacoustic masking threshold is calculated not on a line basis but on a scale factor band basis. This means that instead of considering the energy of individual spectral lines the total energy of e.g. 20 spectral lines in a scale factor band is the relevant criterion. However, in a scale factor band in which many watermark spectral lines can be tolerated, a few lines can be safely dispensed with in the interests of a good audio quality without the watermark detectability suffering significantly. This functionality can be also be achieved in the embodiment shown in FIG. 2 by implementing the weighting control 34 in such a way that instead of employing the same weighting factor regardless of the frequency, a different weighting factor is used for different spectral values and so that, in particular, a weighting factor of 0 occurs for individual spectral lines. As regards the predetermined watermark initial value, it can be advantageous in the embodiment shown in FIG. 2 to implement the watermark weighting prior to the iteration so that it is derived from the psychoacoustic masking threshold.

In summary, the concept according to the present invention is such that a spectral representation of the watermark signal is first generated. This watermark signal is weighted by means of weighting factors. The weighted signal is added to the original audio signal, which is available in its spectral representation. Alternatively, the lines of the original audio signal, which is available in its spectral representation, are modified on the basis of the watermark signal. The interference introduced after quantization is then determined, the interference due to quantization, inverse quantization and the formation of differences in relation to the original being ascertained or the interference being precalculated.

Subsequently new weighting factors are determined using the masking threshold and using a line selection strategy, in particular a line selection strategy which takes account of the sign and magnitude of the spectral lines of the unweighted watermark, the sum of the watermark line and original spectral line being so determined that this new spectral line falls within a different quantization interval than the original spectral line.

The concept according to the present invention is advantageous in that it can be employed both for bit stream watermark methods and for methods which perform audio encoding and watermark embedding in a single step.

A further advantage of the concept according to the present invention is that it is possible to achieve full control over the interference which is introduced. This means that the method can be so adjusted as to achieve optimal watermark detection or optimal audio quality.

Yet another advantage of the concept according to the present invention is that is provides full control over the frequency distribution of the watermark spread band signal in the audio signal.

What is claimed is:

1. A method for embedding a watermark in an audio signal, comprising the following steps:

providing a spectral representation of the audio signal, wherein the spectral representation of the audio signal has a plurality of audio spectral values;

providing a spectral representation of the watermark signal, wherein the spectral representation of the watermark signal has a plurality of watermark spectral values;

processing the spectral representation of the watermark signal in response to a psychoacoustic masking threshold of the audio signal to obtain a processed watermark signal such that the interference introduced into the audio signal by the processed watermark signal lies below a predetermined interference threshold which depends on the psychoacoustic masking threshold; and combining the processed watermark signal and the audio signal to obtain a watermark-bearing audio signal in which the watermark is embedded, wherein the step of processing comprises the following substeps:

selecting a predetermined watermark initial value, which depends on the spectral representation of the watermark signal;

determining the interference introduced into the spectral representation of the audio signal by the predetermined watermark initial value after quantization of the spectral representation of the audio signal; and if the interference introduced by the watermark spectral value exceeds the predetermined interference threshold, modifying the watermark initial value until the interference introduced into the spectral representation of the audio signal by a modified watermark initial value after quantization of the audio signal is smaller than or equal to the predetermined interference threshold, and using the modified watermark initial value as the processed watermark signal.

2. A method according to claim 1, wherein in the substep of selecting watermark spectral values are weighted with initial weighting factors;

wherein in the step of determining, the watermark spectral values weighted with the initial weighting factors are added to the audio spectral values to obtain addition spectral values;

wherein the addition spectral values are quantized and then inversely quantized to obtain inversely quantized addition spectral values;

wherein the inversely quantized addition spectral values are compared with the audio spectral values to determine whether the interference in the addition spectral values lies below the predetermined interference threshold; and wherein in the substep of modifying, the initial weighting factors are modified.

3. A method according to claim 2, wherein the initial weighting factors for all watermark spectral values are the same and of a magnitude which is so chosen that the energy of the watermark lies above the psychoacoustic masking threshold.

4. A method according to claim 2, wherein the initial weighting factors are obtained by weighting of the watermark spectral values with the psychoacoustic masking threshold so that the energy of the watermark spectral values weighted with the psychoacoustic masking threshold approximates to the psychoacoustic masking threshold and is, in particular, smaller than or equal to the psychoacoustic masking threshold.

5. A method according to claim 3, wherein the initial weighting factors in the substep of modification are reduced for each iteration step.

6. A method according to claim 2, wherein the step of combining comprises combining the spectral values of the audio signal and the spectral values of the processed watermark signal and subsequently the step of quantizing the watermark-bearing audio signal using quantization stages which were determined by quantization of the audio spectral values without the watermark signal using the psychoacoustic masking threshold so as to obtain a quantized watermark-bearing audio signal.

7. A method according to claim 1, wherein the substep of selecting a watermark initial value comprises the following substeps:

determining quantization stages for the audio spectral values without the watermark signal using the psychoacoustic masking threshold;

quantizing the audio spectral values using the determined quantization stages so as to obtain quantized audio spectral values;

extracting the signs of the watermark spectral values;

calculating quantized spectral values of the watermark initial value so that a quantized spectral value of the watermark initial value is equal to a number of quantization stages if the sign of the corresponding spectral value of the watermark signal is positive and so that a quantized spectral value of the watermark initial value is equal to minus a number of quantization stages if the sign of the corresponding spectral value of the watermark signal is negative; and wherein the step of modifying comprises the step of setting the number of quantization stages and/or the step of selecting spectral lines of the watermark initial value as the modified watermark initial value.

8. A method according to claim 7, wherein no spectral values of the watermark initial value are selected as modified watermark initial value for quantized spectral values of the audio signal which are equal to 0.

9. A method according to claim 7, wherein a bit banking function is incorporated and wherein, depending on the filling status of the bit bank, spectral values of the watermark initial value are selected as modified watermark initial value for quantized spectral values of the audio signal which are equal to 0.

10. A method according to claim 1, wherein the step of modifying is so performed that the greatest possible number of modified watermark spectral values differ from 0.

11. A method according to claim 1, wherein the step of modifying is so performed that the variation of the modified watermark initial value with frequency corresponds as closely as possible to the spectral variation of the watermark signal.

12. A method according to claim 1, wherein quantized audio spectral values are added to selected watermark spectral values to obtain a quantized watermark-bearing audio signal.

13. A method according to claim 1, wherein the substep of modifying is discontinued when the interference threshold is reached or is not exceeded and when at the same time the number of modified watermark spectral values exceeds a predetermined threshold.

14. A method according to claim 13, wherein the predetermined energy threshold is so defined that a predetermined number of audio spectral values of a signal comprising the audio spectral values and the modified watermark spectral values are modified by at least one quantization stage compared with the quantized spectral values of the audio signal alone.

15. A method according to claim 1, wherein the psychoacoustic masking threshold has one value for each scale factor band, and wherein the step of processing is performed on the basis of the scale factor bands.

16. A device for embedding a watermark in an audio signal, comprising:

a unit for providing a spectral representation of the audio signal, wherein the spectral representation of the audio signal has a plurality of audio spectral values;

a unit for providing a spectral representation of the watermark signal, wherein the spectral representation of the watermark signal has a plurality of watermark spectral values;

a unit for processing the spectral representation of the watermark signal in response to a psychoacoustic masking threshold of the audio signal to obtain a processed watermark signal such that the interference introduced into the audio signal by the processed watermark signal lies below a predetermined interference threshold which depends on the psychoacoustic masking threshold; and a unit for combining the processed watermark signal and the audio signal to obtain a watermark-bearing audio signal in which the watermark is embedded, wherein the unit for processing comprises:

a unit for selecting a predetermined watermark initial value, which depends on the spectral representation of the watermark signal;

a unit for determining the interference introduced into the spectral representation of the audio signal by the predetermined watermark initial value after quantization of the spectral representation of the audio signal;

a unit for determining whether the interference introduced by the watermark initial value exceeds the predetermined interference threshold; and a unit for modifying the watermark spectral values until the interference introduced into the spectral representation of the audio signal by a modified watermark initial value after quantization is smaller than or equal to the predetermined interference threshold, and for using the modified watermark spectral values as the processed watermark signal.

* * * * *